United States Patent [19]

Wilson et al.

[11] 4,248,188

[45] Feb. 3, 1981

[54] HYDRAULIC ATTENUATOR FOR AIR FUEL CONTROL PUMP

[75] Inventors: Harry L. Wilson; David E. Shultz, both of Columbus, Ind.

[73] Assignee: Cummins Engine Company, Inc., Columbus, Ind.

[21] Appl. No.: 974,563

[22] Filed: Dec. 29, 1978

[51] Int. Cl.[3] ..... F02M 39/00; F02D 1/04

[52] U.S. Cl. ..... 123/382; 123/390; 123/371; 251/61.4; 123/463

[58] Field of Search ..... 123/140 MP, 140 FG, 123/139 AW; 137/513.3, 513.7, 312; 251/61.4, 51, 55, 117

[56] References Cited

U.S. PATENT DOCUMENTS

| | | | |
|---|---|---|---|
| 2,552,960 | 5/1951 | Grieshaber | 137/312 |
| 2,894,735 | 7/1959 | Zupanic | 261/69 |
| 3,726,263 | 4/1973 | Kemp | 123/139 AW |
| 3,896,843 | 7/1975 | Millar | 251/61.4 |
| 3,981,288 | 9/1976 | Wessel | 123/139 AW |
| 4,015,571 | 4/1977 | Stumpp | 123/139 AW |
| 4,059,088 | 11/1977 | Tateno | 123/198 DB |
| 4,095,572 | 6/1978 | Scholtz | 123/140 MP |
| 4,187,817 | 2/1980 | Wilson | 123/139 AW |

*Primary Examiner*—Charles J. Myhre
*Assistant Examiner*—Carl Stuart Miller
*Attorney, Agent, or Firm*—Sixbey, Friedman & Leedom

[57] ABSTRACT

A diaphragm operated, air fuel control system for controlling the rate of fuel flow to an internal combustion engine in response to intake manifold pressure is disclosed wherein the transient response of the diaphragm operator is attenuated by a fuel filled control chamber. An attenuator assembly connected with the control chamber causes fuel to be supplied to the chamber at a rate which is greater than the rate at which fuel may be discharged from the control chamber. In one embodiment the chamber is formed on the side of the diaphragm operator which is opposite to the side to which intake manifold pressure is supplied. In another embodiment the control chamber is formed to receive one end of a plunger valve connected with the diaphragm operator.

11 Claims, 7 Drawing Figures

HYDRAULIC ATTENUATOR FOR AIR FUEL CONTROL PUMP

TECHNICAL FIELD

This invention relates to an air fuel control system for internal combustion engines. More specifically, this invention relates to a hydraulic attenuator for an air fuel control valve responsive to intake manifold pressure in a turbo-charged compression ignition internal combustion engine of the type which is operationally controlled by variations in fuel pressure.

BACKGROUND ART

The reduction of emission components from the exhausts of internal combustion engines is one of the objectives sought by virtually every manufacturer of such engines. For some time it has been recognized that one of the best methods for controlling emissions is to supply fuel and air to the engine cylinders in a ratio which allows complete combustion under all operating conditions, thereby severely limiting the production of components which require removal from the engine exhaust. If the air fuel ratio is controlled carefully enough, the need for apparatus to remove emissions to achieve acceptable emission control can be entirely eliminated. One approach to achieving this desirable air-fuel ratio has been to provide a fuel metering system which is responsive to changes in pressure within the system. U.S. Pat. Nos. 2,894,735 to Zupancic, 3,726,263 to Kemp and 4,015,571 to Stumpp all disclose earlier attempts to regulate the air fuel mixture in internal combustion engines through such a system. In U.S. Pat. No. 2,894,735 Zupancic describes a fuel metering system responsive to manifold pressure and in U.S. Pat. No. 4,015,571 Stumpp discloses a fuel metering system including a throttle which is responsive to pressure changes in the entire fuel system once the desired air-fuel ratio is chosen. Kemp, in U.S. Pat. No. 3,726,263, describes a fuel flow control which provides a diaphragm subjected to manifold pressure on one side to modulate fuel flow to the engine in response to changing manifold pressure while the reverse side of the diaphragm is connected with a fuel drain line so that fuel leaking within the fuel flow control is returned to the fuel tank.

Systems of the type described above can be used in engine fuel systems of the type having a common rail supplying the cylinder injectors with a varying fuel pressure to control engine speed. However, it has been found that the fuel to air ratio supplied to the engine cylinders in such systems is not always maintained at the ideal level even when an air fuel control is employed to modulate fuel flow to the engine in response to changing manifold pressure. For example, some limitation appears to be required in the rate of increase in fuel flow to the engine in response to increasing manifold pressure. Without such a limitation, a highly undesirable fuel to air ratio may be supplied to the engine cylinders under certain operating conditions. The limitation provides a beneficial reduction in combustion noise as well as smoke. On the other hand, a very quick response to decreasing intake manifold pressure is desirable in order to reduce immediately the fuel flow to the engine as soon as the manifold pressure begins to decrease. To achieve this desirable transient response, it has been known to provide an air attenuator valve assembly in the air signal line extending between the intake manifold and the air fuel control valve. The attenuator valve assembly (consisting of a check valve and restriction orifice connected in parallel) allows free flow of air through the check valve and the air signal line upon decreasing manifold pressure but requires return flow of air in the air signal line to pass through the restriction orifice to limit thereby the transient response of the air fuel control. Although such attenuator assemblies provide the desired fuel flow modulating characteristics in response to changes in manifold pressure so long as they remain operable, the trouble free operating life of this type of assembly is normally insufficient from a commercial standpoint. In particular, such assemblies are susceptible to clogging by air borne particles. Filtering of the air has not been shown to present a satisfactory solution. None of the prior art systems which employ flexible diaphragm means to separate high and low pressure areas has fully solved the problems presented by leaks in the diaphragm and the resulting presence of fuel in the manifold and subsequent effects which could accompany such a leak. Kemp, in U.S. Pat. No. 3,726,263, does suggest a technique for recycling leakage fuel by connecting one side of a diaphragm operator to a fuel drain line but does not suggest a technique for simultaneously modulating the transient response of the fuel control valve.

DISCLOSURE OF THE INVENTION

The primary object of this invention is to overcome the disadvantages of the prior art as noted above and, specifically, to provide an improved air fuel control system including a reliable hydraulic attenuator for establishing the transient response characteristics of the air fuel control which are capable of effecting the optimal supply of air fuel to the internal combustion engine.

Another object of this invention is to provide an improved attenuator for use with the air fuel control of an internal combustion engine fuel supply system wherein the attenuator is less susceptible to clogging by dirt and other foreign particles as compared with prior art attenuators.

A further object of the present invention is to provide an improved attenuator for use with an air fuel control system which utilizes a control fluid which is selected from an existent liquid system within the engine, such as the engine fuel system.

It is more specifically an object of the present invention to provide an air fuel control system for an internal combustion engine of the type which is operationally controlled by the pressure of fuel supplied thereto which will provide controlled modulation of the flow of fuel to the engine when the intake manifold pressure is increasing and will further provide a rapid reduction in the flow of fuel to the engine corresponding to decreasing manifold pressure.

It is an additional object of the present invention to avoid the undesirable results caused by the leakage of fuel within the air fuel control mechanism. In accord with this objective, one embodiment of the present invention provides an air fuel control mechanism for regulating the fuel supplied to an internal combustion engine which is modified by the provision of a fuel-filled chamber on the opposite side of a flexible diaphragm member from the intake manifold. A more desirable transient response characteristic is obtained and the adverse effects of fuel leakage are avoided by the connection of the fuel-filled chamber with the engine fuel tank by means of a drain line including the hydraulic attenuator of the present invention which contains a check valve and a restricted orifice connected in parallel so that the check valve restricts the flow of fluid from the chamber to fuel tank, but poses no restriction in the opposite direction, thus controlling the rate at which fuel is supplied from the fuel pump to the engine.

Still other and more specific objects of this invention can be appreciated by consideration of the following Brief Description of Drawings and the following description of the Best Mode for Carrying Out the Invention.

BEST MODE FOR CARRYING OUT THE INVENTION

Figure 1:
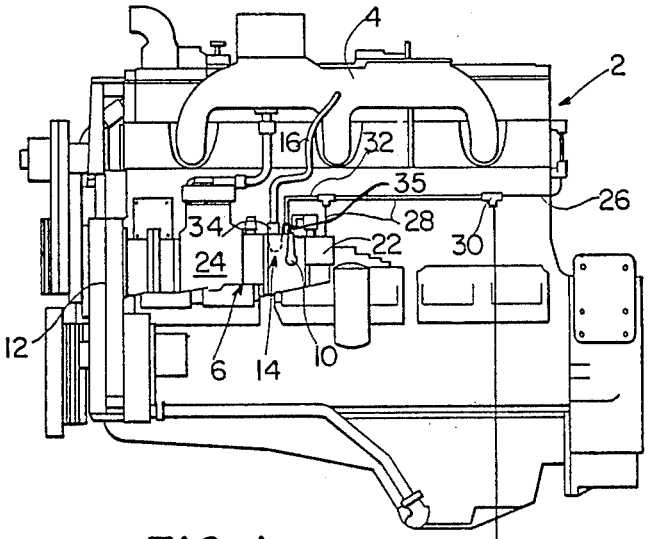
FIG. 1 is a side elevational view of an internal combustion engine equipped with a fuel supply system designed in accordance with the subject invention.

In order to understand the operation of the subject invention, it is desirable first to consider a typical type of fuel system in which it is likely to be employed. For this purpose, reference is made to FIG. 1, wherein a compression ignition internal combustion engine 2 is illustrated including an intake manifold 4 and a fuel supply system, shown generally at 6. Engine 2 is of the type which is controlled by the pressure of fuel supplied thereto by the fuel supply system 6. In particular, engine 2 includes a plurality of cylinders into which fuel is injected by injectors (not illustrated) synchronously actuated with the movement of the engine pistons, respectively. The amount of fuel actually injected into each cylinder is dependent on the pressure supplied to the common line by the fuel supply system which, in turn, is determined by a scheduled pressure output as a function of operator demand, indicated by the position of throttle lever 10, and as a function of the engine RPM. The fuel supply system 6 is connected to the engine crankshaft by a gear train 12.

As is common in fuel supply systems of the type illustrated in FIG. 1, a return line 18 is provided between the engine and the fuel tank 20 to provide a path for returning fuel which is sent to, but not injected into, the engine cylinders or which is bled from the gear pump section 22 of the fuel pump 24. The fuel returning from the injectors is connected to return line 18 through branch 26 and the fuel bled from gear pump section 22 is connected to return line 18 by branches 28. Branches 26 and 28 are connected with return line 18 by the Tee connector 30.

In order to achieve more accurate air fuel ratio control within each engine cylinder, the fuel supply system 6 includes an air fuel control 14 for modulating mechanically the flow of fuel into the engine 2 in response to the pressure of the air in the intake manifold 4. This capability is particularly important in turbo-charged engines in which the intake manifold pressure may fall below the rated pressure under certain operating conditions such as during start up and acceleration. The air fuel control 14, which operates as an air pressure responsive means, is connected with the intake manifold 4 through an air line 16.

In order to achieve a more nearly ideal air fuel ratio control over long term operation, the fuel system of FIG. 1 has been equipped with a connection between the return line 18 and the air fuel control valve 14 through line 32 and branch 28. As will be explained more fully hereinbelow, a hydraulic valve attenuator assembly 35 is included within the passage formed by line 32 to cause the transient response of the air fuel control valve 14 to be delayed reliably over long term operation during each occurrence of increasing manifold pressure.

Figure 2:
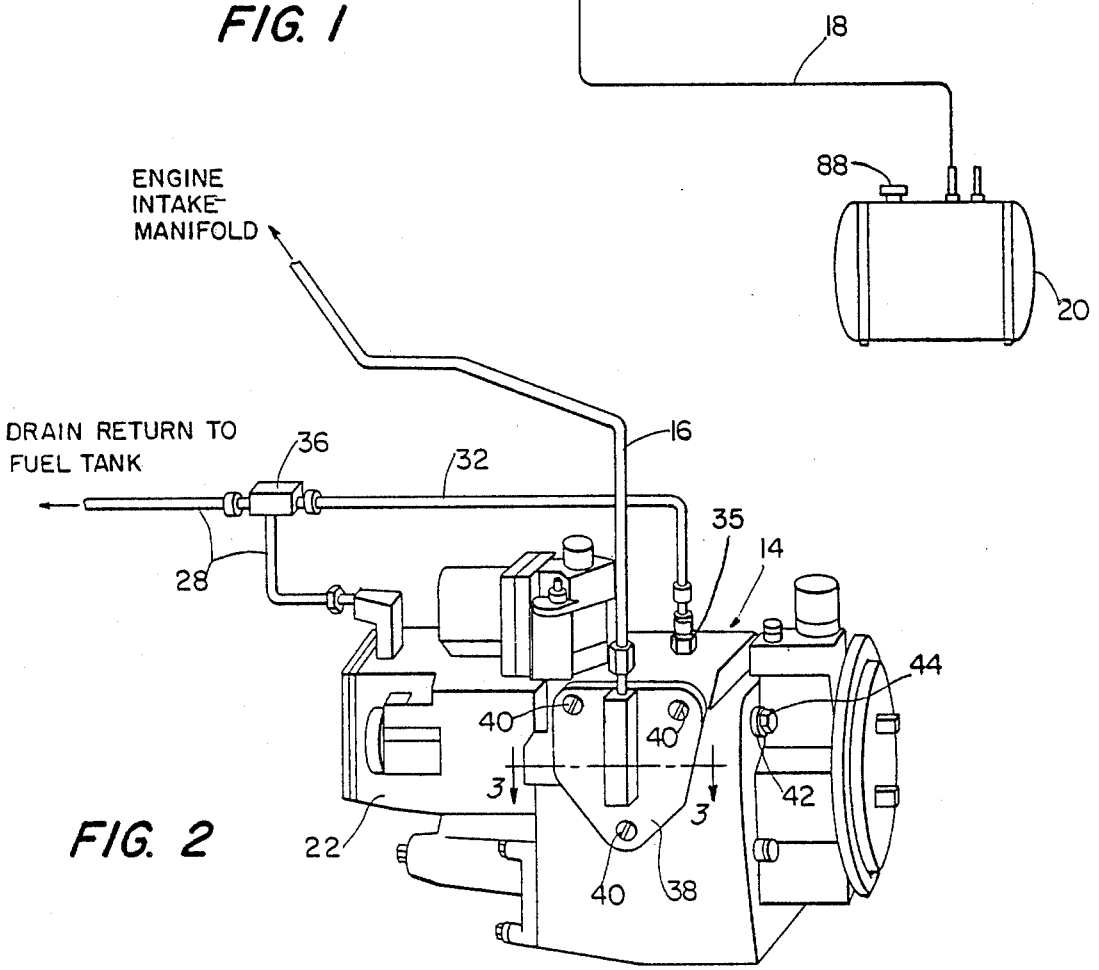
FIG. 2 is a perspective view of a modified air fuel control for modulating fuel flow to the engine in response to the air pressure within the intake manifold of the engine.

Referring now to FIG. 2, the air fuel control 14 and related portions of the fuel supply system are illustrated in perspective view. In particular, the air fuel control 14 is shown as connected to air line 16 to receive a signal indicative of manifold pressure and the drain line 32 is connected at one end to the air fuel control 14 by means of hydraulic valve attenuator assembly 35, discussed in greater detail hereinbelow, and at the other end to branches 28 by means of a Tee connector 36. The view illustrated in FIG. 2 is of the back side of the air fuel control 14 and related structures as illustrated in FIG. 1. This view shows the cover plate 38 connected to the air fuel control 14 by screws 40. The view in FIG. 2 also discloses a seal washer 42 on the front cover cap screw 44 which is designed to seal off fuel leakage through the conventional vent from the inside of the air fuel control 14.

The details of the operation of the air fuel control 14 and the manner by which it operates to modulate the flow of fuel provided to an internal combustion engine in response to the pressure within the intake manifold of the engine, except as they will be specifically described in the present application, are those shown in commonly assigned U.S. patent application Ser. No. 948,872 filed Oct. 5, 1978 and entitled APPARATUS AND METHOD FOR AVERTING SEAL FAILURE IN AN I.C. ENGINE FUEL SUPPLY SYSTEM, the disclosure of which is hereby incorporated by reference.

Figure 3A:
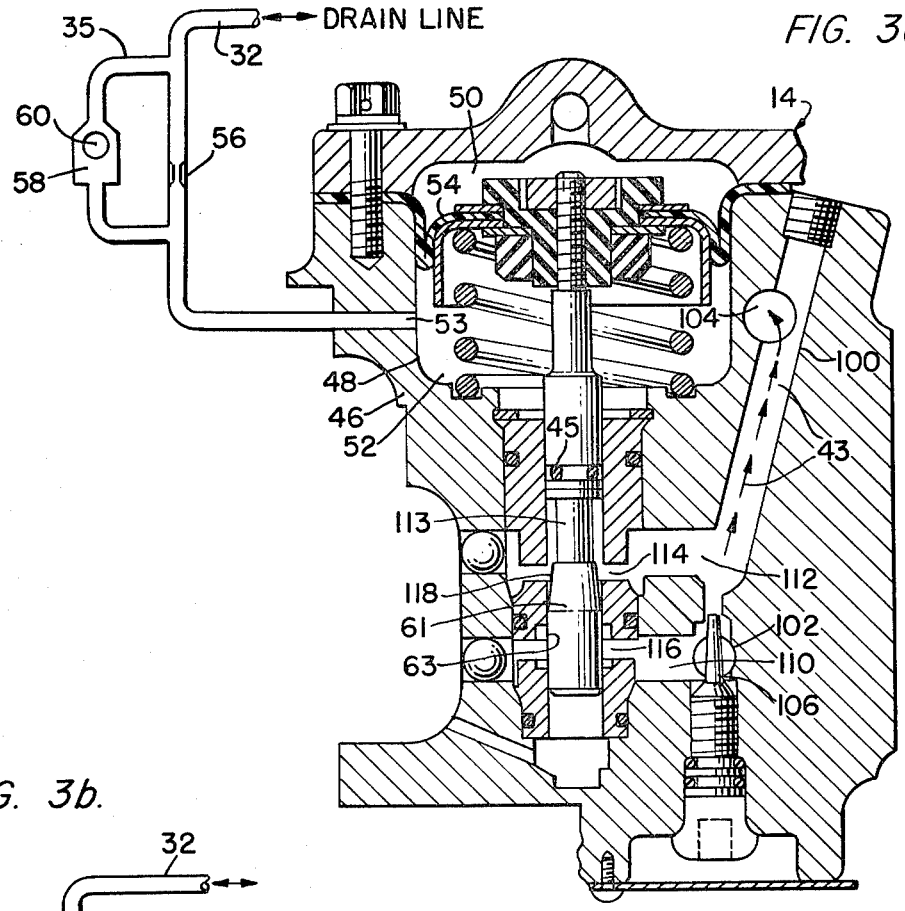
FIGS. 3*a* and 3*b* are cross-sectional views of the air fuel control illustrated in FIG. 2 taken along lines 3—3 and showing the placement of the hydraulic air signal attenuator of the present invention; with FIG. 3*a* illustrating low manifold pressure operation and FIG. 3*b* illustrating rated manifold pressure operation.
Figure 3B:
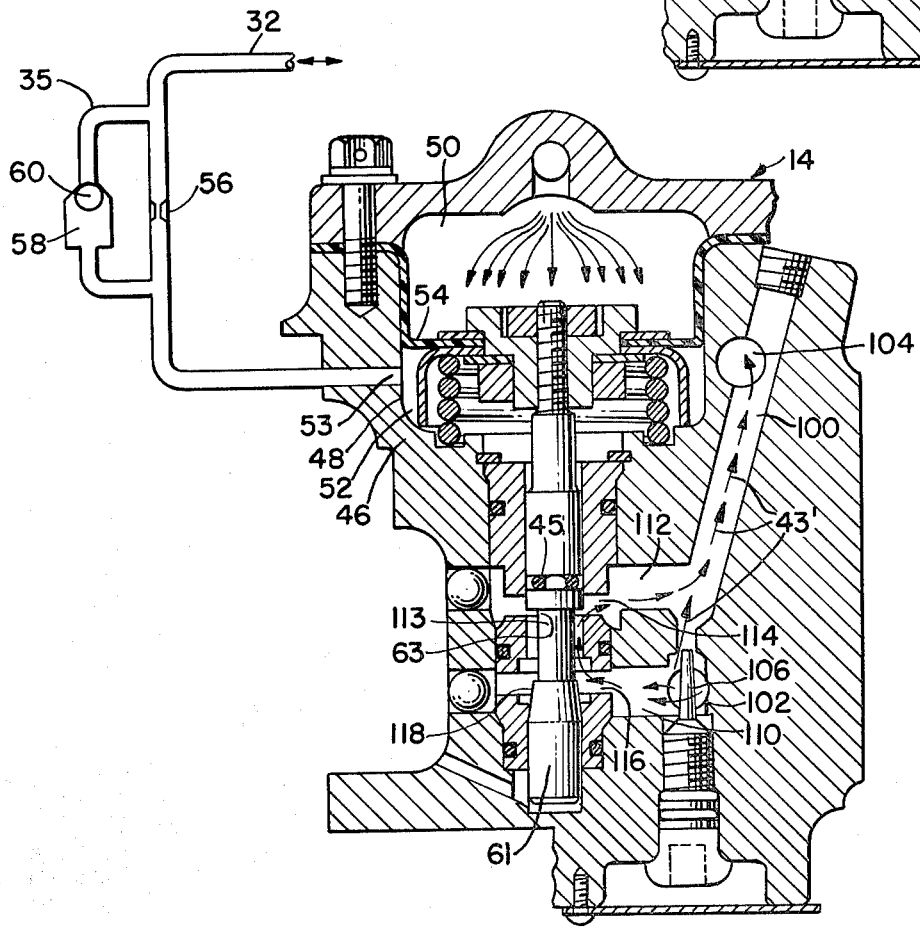

Reference is made now to FIGS. 3*a* and 3*b* which show a cross sectional view of the air fuel control 14 taken along line 3—3 of FIG. 2. FIG. 3*a* illustrates the condition of the air fuel control during a "no-air" condition, that is, when the pressure within the intake manifold is near zero pressure level. FIG. 3*b* depicts the condition of the air fuel control 14 when the pressure within the intake manifold has reached its full rated level. The purpose of the structure illustrated in FIG. 3*a* is to form a restrictor for providing the proper fuel rate for the available air in the engine cylinders. When properly adjusted, a fuel air control mechanism as shown in FIG. 3*a* is capable of providing optimum engine response and emission control during all normal engine operating conditions wherein the pressure within the intake manifold is other than at the rated level.

The air fuel control mechanism 14 shown in FIG. 3*a* includes a housing 46 containing a control cavity 48 subdivided into a first chamber 50 and a second chamber 52 by a flexible diaphragm 54. When the air fuel control 14 is in the position depicted in FIG. 3*a*, the fuel path is shown by the arrows 43 between the no-air needle valve and the outlet port marked fuel to shutdown valve. The seal shown at 45 keeps fuel from entering chamber 52 but as will be explained below, seal 45 may be eliminated. The purpose of the present invention is to impart a transient response characteristic to the air fuel control 14 which causes the control to respond more quickly to manifold pressure decreases than to manifold pressure increases. The present invention provides a source of fuel at very low pressures, less than about 1.0 p.s.i., to cause fuel flow into chamber 52 so that chamber 52 is, at all times, filled with fuel. Fuel is supplied to chamber 52 by means of a line 32 communicating with chamber 52 through an opening 53 formed in housing 46 wherein the line 32 is provided with an attenuator assembly 35 designed in accordance with the present invention. The other end of line 32 is connected with the drainline 18 through Tee 36, branch 28 and Tee 30 (FIGS. 1 and 2) or is connected to the feed line interconnecting the inlet or suction side of the engine fuel pump. It will be noted at this point and described in more detail below that the attenuator assembly 35 provides a restricted orifice 56 in parallel arrangement with a check valve 58. Thus, fuel may flow from the fuel source (either drain line 18 or fuel feed line) through both the valve 58 and the orifice 56 to fill chamber 52 when the air fuel control 14 is in the "no-air" position of FIG. 3*a*. It can be observed in FIG. 3*a* that the air fuel control 14 includes a throttle plunger 61 connected with diaphragm 54 for reciprocal movement within a cavity 63. The purpose of plunger 61 is to control the flow of fuel from the engine fuel pump to the various engine cylinders. This is accomplished by modulating the flow through a passage 100 connected at one end to a port 102 to which fuel is fed by the engine fuel pump and at the other end to a port 104 which feeds fuel to the engine cylinders through a common rail. Within passage 100 is a needle valve 106 which may be adjusted to allow the proper amount of fuel to flow through passage 100 when the air flow control 14 is in a "no-air" condition.

To permit a greater flow of fuel to the engine as the pressure within the intake manifold increases, a bypass is provided around valve 106 including passages 110 and 112 and a recessed portion 113 of plunger 61 which may be positioned to allow communication between passages 110 and 112 through ports 114 and 116. A chamfered surface 118 formed on plunger 61 and positioned at one end of recess 113 causes the fuel flow through the bypass around valve 106 to be modulated in accordance with the position of diaphragm 54 and thus is dependent upon pressure within the intake manifold.

FIG. 3*b* illustrates the system of the present invention in a "full-air" position, that is when the manifold pressure is high. The effect of the higher pressure is to push against diaphragm 54, forcing the throttle plunger 61 as far as it will go, allowing greater fuel flow to the engine, as shown by arrows 43'. Since the diaphragm 54 and its related mechanisms are forced downwardly by the increased air pressure, the fuel within chamber 52 is fored through opening 53 into line 32. The attenuator assembly 35 controls the rate at which fuel leaves chamber 52, thereby controlling the rate of movement of the throttle plunger 61. The fuel flowing through the line forces ball 60 in check valve 58 into a closed position, leaving only restricted orifice 56 for fuel to flow through. Therefore, as the manifold pressure increases, fuel if forced from chamber 52 into line 32 through restricted orifice 56. When the fuel reaches the level of check valve 58 and closes it as described herein below, flow is slowed to the rate at which it can pass through restricted orifice 56. Although not shown, it should be noted that throttle plunger 61 can occupy intermediate positions between the "no-air" position shown in FIG. 3*a* and the "full-air" position shown in FIG. 3*b*. When the manifold air pressure decreases below the rated level, the throttle plunger 61 moves toward the "no-air" position and fuel from line 32 then flows unrestricted by check valve 58 into chamber 52. In the embodiment of FIGS. 3*a* and 3*b*, chamber 52 can be considered an attenuator chamber since the flow of fuel out of this chamber at a controlled rate results in the attenuation of movement of the plunger 61.

Figure 4A:
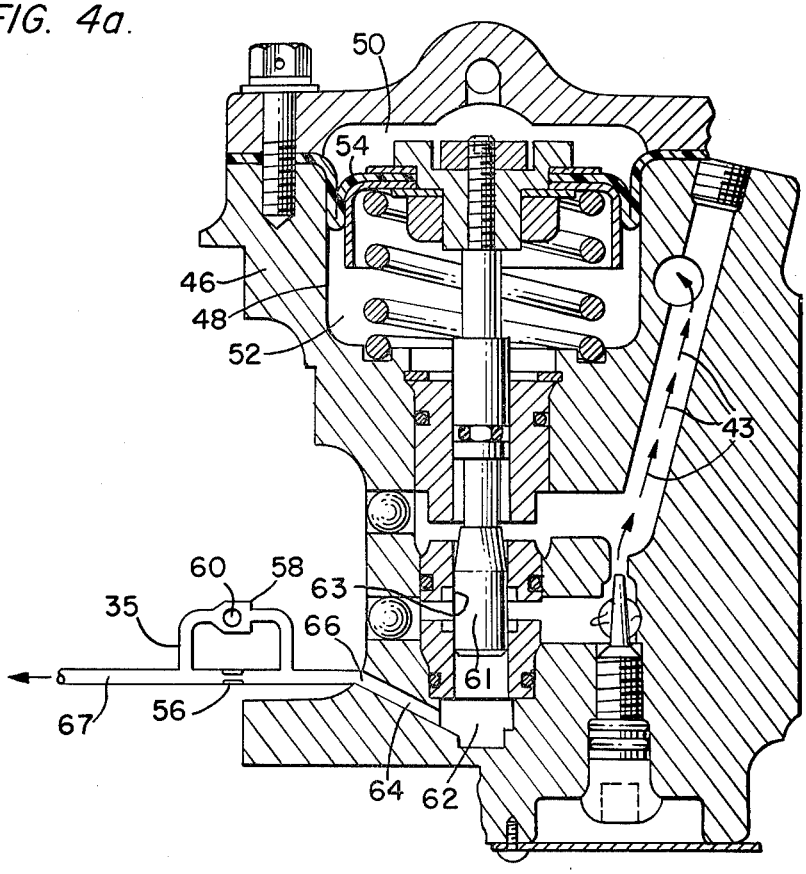
FIGS. 4*a* and 4*b* are cross-sectional views of the air fuel control illustrated in FIG. 2 taken along lines 3—3 and showing an alternate placement of the hydraulic air signal attenuator of the present invention; with FIG. 4*a* illustrating low manifold pressure operation and FIG. 4*b* illustrating rated manifold pressure operation.
Figure 4B:
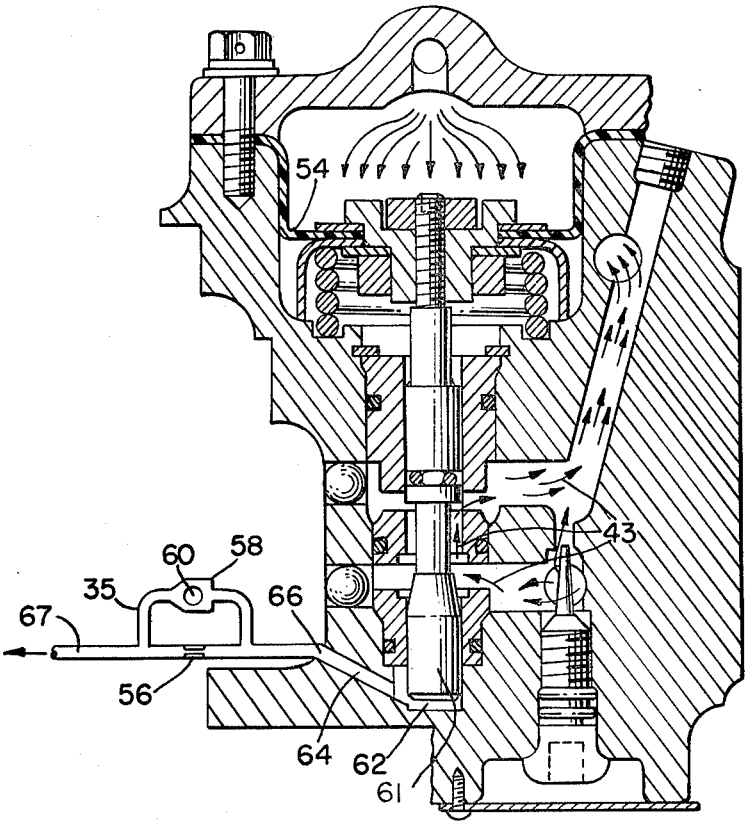

FIGS. 4*a* and 4*b* show the air fuel control 14 in the same two "no-air" and "full-ir" positions shown in FIGS. 3*a* and 3*b*, and further depict a second embodiment of the present invention. In this embodiment an attenuation chamber 62 is formed at the end of the throttle plunger 61 within cavity 63. While in the embodiment of FIGS. 3*a* and 3*b* this chamber is vented to the fuel pump body, in FIG. 4*a* and 4*b* it can be seen that this chamber is connected to a line 67 leading to a fuel or fluid supply source in the same manner as line 32 in the embodiment of FIGS. 3*a* and 3*b*. An attenuator assembly 35 identical to that described with reference to FIGS. 3*a* and 3*b* is included within line 67. In FIG. 4*a* intake manifold pressure is low and attenuating chamber 62 is full of fluid. Fuel flow to the engine cylinders is restricted to the path shown by arrows 43. As the intake manifold pressure increases, fluid is forced out of attenuating chamber 62 by the advancing plunger into line 64 through port 66 into attenuator assembly 35. As described above, the force of the fluid against ball 60 in check valve 58 closes the valve and fluid flow is thus confined to restricted orifice 56. This results in throttle plunger 61 moving more slowly than it would if fluid was permitted to flow through both orifice 56 and valve 58. FIG. 4*b* illustrates the position of the throttle plunger 61 in attenuating chamber 62 when the manifold pressure is at its rated level and maximum fuel flow to the engine is achieved along the path shown by arrows 43. As can be seen in FIG. 4*a*, there is very little space occupied by fluid in attenuating chamber 62 when the plunger is in this position. However, when the manifold pressure begins to decrease and the plunger begins to move from the position shown in FIG. 4*b* to the position shown in FIG. 4*a*, fluid then flows through attenuator assembly 35, through port 66 and line 64 and into attenuating chamber 62. Fluid flowing in this direction flows through both orifice 56 and check valve 58 of attenuator assembly 35 to allow the movement of the throttle plunger 62 at a rate which decreases fuel flow to the engine cylinders in an amount which corresponds with the decreasing manifold pressure.

Figure 5:
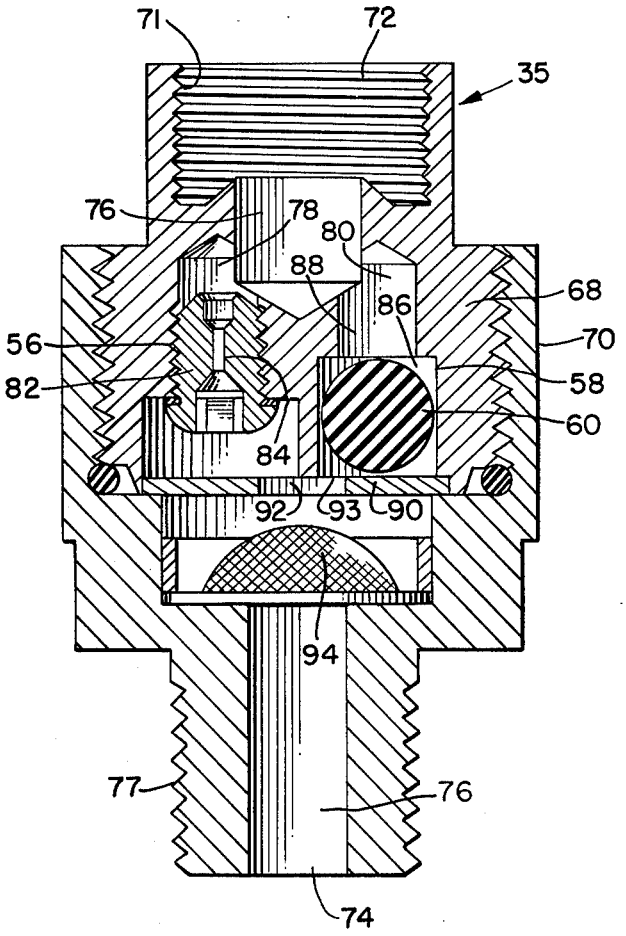
FIG. 5 is a cross-sectional view of the hydraulic air signal attenuator of the present invention.

FIG. 5 illustrates the attenuator assembly 35 of the present invention. Attenuator assembly 35 includes a valve housing 68 in which is threaded for connection into a fitting 70 in the form of a telescoping outer cup-shaped element, and ports 72 and 74 at opposite ends of assembly 35 formed in housing 68 and fitting 70, respectively. Port 72 provides interior threads 71 for connection with line 32. Port 74 provides exterior threads 77 for connection with an air fuel control 14, thereby communicating with chamber 52. The single fluid flow passage 76 into which port 72 leads is divided into a first fluid flow passage 78 and a second fluid flow passage 80, which then converge to reform into a single fluid flow passage 76 which includes port 74. The interior of first passage 78 is threaded to receive restriction member 82, which provides a restricted orifice 84 within first passage 78. Second passage 80 includes check valve 58, which is connected in parallel with restriction member 82. Second passage 80 connects with enlarged cavity 86 which contains ball 60 of check valve 58. Ball 60 must have a diameter larger than the diameter of second passage 80 so that fluid flowing into assembly 35 through port 74 will push ball 60 into second passage 80 at 88, thus preventing fluid from flowing through second passage 80. Fluid is then required to flow through restricted path 84 into first passage 78 and out passage 76 through port 72.

Attenuator assembly 35 further includes a washer 90 with center opening 92 which provides for the convergence of first and second fluid flow passages 78 and 80 into single passage 76. Opening 92 registers in part with cavity 86 to form a discharge opening 93. When ball 60 engages washer 90 at one end of cavity 60, fuel may still flow through opening 93 as is apparent in FIG. 5. A dome-shaped screen 94 is provided to act as a filter for the fluid passing through assembly 35.

Assembly 35 is connected so that port 74 is proximal and port 72 is distal to air fuel control 14. Fluid flows through port 72, into passage 76 and then through both first and second fluid flow passages 78 and 80, flowing then through both restriction passage 84 and check valve cavity 86, through washer opening 92, filter 94, into passage 76 and out port 74 into the air fuel control chamber as the manifold pressure decreases. When the manifold pressure increases, fluid leaves the air fuel control chamber and flows through port 74, into passage 76, through filter 94, through washer opening 92 and into enlarged cavity 86 and restricted orifice 56. However, the force of the fluid will force ball 60 into point 88 between cavity 86 and passage 80, preventing fluid flow through passage 80. Fluid is then required to flow through restricted passage 84 and then into passages 78 and 76 and out port 72.

Other aspects, objects and advantages of this invention can be obtained from a study of the drawings, the disclosure and the appended claims.

An additional advantage of the present invention accrues from the fact that chamber 52 is filled with fuel at all times. Therefore, small leaks in seal 45 or around plunger 61 would result in the flow of fuel into chamber 52 without any adverse effects. In addition, seal 45, required to be of high quality material, can be eliminated, which reduces the cost of manufacturing the air fuel control of the present invention.

We claim:

1. A fuel supply system for an internal combustion engine having a fuel source, a pump for supplying fuel from the source to the engine, a drain line for returning fuel from the engine to the fuel source, and an intake manifold for supplying air to the engine, comprising (a) air pressure responsive means for modulating mechanically the flow of fuel into the engine in response to the pressure of air within the intake manifold, said air pressure responsive means including
  (1) a cavity
  (2) pressure responsive actuating means connected within said cavity for transforming changes in intake manifold pressure into mechanical movement for operating said air pressure responsive means, said pressure responsive actuating means including a flexible diaphragm dividing said cavity into a control chamber and an attenuating chamber, and
  (3) an air line connecting said intake manifold with said control chamber; and (b) transient response modifying means for causing said air pressure responsive means to respond more slowly to increasing pressure within the intake manifold than to decreasing pressure, said transient response modifying means including
  (1) passage means for forming a passageway between the drain line and said attenuating chamber to cause fuel to flow into and out of said attenuating chamber in response to mechanical movement of said pressure responsive actuating means, and
  (2) attenuator means connecting with said passage means for restricting the flow of fuel through said passage in one direction while permitting relatively unrestricted flow in the opposite direction, wherein said attenuator means includes a valve assembly having first and second ports and having first and second parallel passageways extending between said first and second ports, said first passageway including a check valve means for allowing relatively unrestricted flow of fluid from said source of fluid into said attenuating chamber and for prevention of flow of fluid from said attenuating chamber back to said source of fluid, said second passageway including a flow restriction means for restraining the fluid flow rate through said second passageway to a predetermined level, wherein said check valve means includes an enlarged cavity at the end of said first passageway leading to said attenuating chamber, and wherein said valve assembly includes an inner valve housing and an outer cup-shaped fitting telescopingly interconnected with said valve housing, said enlarged cavity having a central axis parallel to and laterally spaced from the central axis of said valve housing, said valve assembly including a washer member having an outside diameter smaller than the inside diameter of said valve housing, said washer member including a centrally located aperture only partially registered with said enlarged cavity, said check valve means further including a valve element located within said enlarged cavity and movable in a first direction away from said washer element to close off flow through said check valve and movable in an opposite direction to engage said washer element in a position which permits fluid flow out of said enlarged cavity through an opening formed by the partial registration of said centrally located aperture and said enlarged cavity.

2. A fuel supply system for an internal combustion engine having a fuel source, a pump for supplying fuel from the source to the engine, a drain line for returning fuel from the engine to the fuel source, and an intake manifold for supplying air to the engine, comprising (a) air pressure responsive means for modulating mechanically the flow of fuel into the engine in response to the pressure of air within the intake manifold, said air pressure responsive means including
  (1) a cavity
  (2) pressure responsive actuating means connected within said cavity for transforming changes in intake manifold pressure into mechanical movement for operating said air pressure responsive means, said pressure responsive actuating means including a flexible diaphragm dividing said cavity into a control chamber and an attenuating chamber, and
  (3) an air line connecting said intake manifold with said control chamber; and (b) transient response modifying means for causing said air pressure responsive means to respond more slowly to increasing pressure within the intake manifold than to decreasing pressure, said transient response modifying means including
  (1) passage means for forming a passageway between the drain line and said attenuating chamber to cause fuel to flow into and out of said attenuating chamber in response to mechanical movement of said pressure responsive actuating means, and
  (2) attenuator means connecting with said passage means by being positioned within said passageway between the drain line and said attenuating chamber for restricting the flow of fuel through said passage in one direction while permitting relatively unrestricted flow in the opposite direction.

3. A fuel supply system as defined in claim 2, wherein said attenuator means includes a valve assembly having first and second ports and having first and second parallel passageways extending between said first and second ports, said first passageway including a check valve means for allowing relatively unrestricted flow of fluid from said source of fluid into said attenuating chamber and for prevention of flow of fluid from said attenuating chamber back to said source of fluid, said second passageway including a flow restriction means for restraining the fluid flow rate through said second passageway to a predetermined level.

4. A fluid supply system, for an internal combustion engine having a fuel source, a pump for supplying fuel from the source to the engine and an intake manifold for supplying air to the engine, comprising (a) air pressure responsive means for modulating mechanically the flow of fuel into the engine in response to the pressure of air within the intake manifold, said air pressure responsive means including
  (1) a control chamber,
  (2) pressure responsive actuating means connected with said control chamber for transforming changes in intake manifold pressure into mechanical movement for operating said air pressure responsive means, and
  (3) an air line connecting said intake manifold with said control chamber; and (b) transient response modifying means for causing said air pressure responsive means to respond more slowly to increasing pressure within the intake manifold than to decreasing pressure, said transient response modifying means including
  (1) a source of fluid
  (2) an alternating chamber having a volume which varies directly with mechanical movement of said pressure responsive actuating means,
  (3) passage means for forming a fluid flow passage between said source of fluid and said attenuating chamber to cause fluid to flow into and out of said attenuating chamber in response to mechanical movement of said pressure responsive means, and
  (4) attenuator means connected with said passage means for restricting flow of fluid through said passage in one direction while permitting relatively unrestricted flow in the opposite direction, said attenuator means includes a valve assembly having first and second ports and having first and second parallel passageways extending between said first and second ports, said first passageway including a check valve means for allowing relatively unrestricted flow of fluid from said source of fluid into said attenuating chamber and for prevention of flow of fluid from attenuating chamber back to said source of fluid, said second passageway including a flow restriction means for restraining the fluid flow rate through said second passageway to a predetermined level, wherein said check valve means includes an enlarged cavity at the end of said first passageway leading to said attenuating chamber, and wherein said valve assembly includes an inner valve housing and an outer cup-shaped fitting telescopingly interconnected with said valve housing, said enlarged cavity having a central axis parallel to and laterally spaced from the central axis of said valve housing, said valve assembly including a washer member having an outside diameter smaller than the inside diameter of said valve housing, said washer member including a centrally located aperture only partially registered with said enlarged cavity, said check valve means further including a valve element located within said enlarged cavity and movable in a first direction away from said washer element to close off flow through said check valve and movable in an opposite direction to engage said washer element in a position which permits fluid flow out of said enlarged cavity through an opening formed by the partial registration of said centrally located aperture and said enlarged cavity.

5. A fuel supply system for an internal combustion engine having a fuel source, a pump for supplying fuel from the source to the engine and an intake manifold for supplying air to the engine, comprising (a) air pressure responsive means for modulating mechanically the flow of fuel into the engine in response to the pressure of air within the intake manifold, said air pressure responsive means including
  (1) a control chamber,
  (2) pressure responsive actuating means connected with said control chamber for transforming changes in intake manifold pressure into mechanical movement for operating said air pressure responsive means, and
  (3) an air line connecting said intake manifold with said control chamber; and (b) transient response modifying means for causing said air pressure responsive means to respond more slowly to increasing pressure within the intake manifold than to decreasing pressure, said transient response modifying means including (1) a source of fluid isolated fluidically from the intake manifold, (2) an attenuating chamber isolated fluidically from said control chamber having a volume which varies directly with mechanical movement of said pressure responsive actuating means, (3) passage means for forming a fluid flow passage between said source of fluid and said attenuating chamber to cause fluid to flow into and out of said attenuating chamber in response to mechanical movement of said pressure responsive means, and (4) attenuator means connected with said passage means for restricting flow of fluid through said passage in one direction while permitting relatively unrestricted flow in the opposite direction.

6. A system as defined in claim 5, wherein said attenuating chamber and said control chamber are portions of a single cavity divided by said pressure responsive actuating means.

7. A system as defined in claim 5, wherein said attenuating chamber is disposed remotely from said control chamber and wherein said air pressure responsive means further includes an element mounted for reciprocal movement and extending between said pressure responsive actuating means and said attenuating chamber, said element including at one end a movable piston disposed within said attenuating chamber to vary the effective volume of said attenuating chamber upon mechanical movement of said air pressure responsive means.

8. A fuel supply system as defined in claim 5, wherein said source of fluid is the engine fuel source.

9. A fuel supply system as defined in claim 5, further including a drain line for returning a portion of the fuel removed from the fuel source during engine operation back to the source, and wherein said passage means includes a conduit extending between said drain line and said attenuating chamber.

10. A fuel supply system as defined in claim 8, further including a supply line from the fuel source to the inlet of the pump and wherein said passage means includes a conduit extending between said supply line and said attenuating chamber.

11. A fuel supply system as defined in claim 5, wherein said attenuator means includes a valve assembly having first and second ports and having first and second parallel passageways extending between said first and second ports, said first passageway including a check valve means for allowing relatively unrestricted flow of fluid from said source of fluid into said attenuating chamber and for prevention of flow of fluid from said attenuating chamber back to said source of fluid, said second passageway including a flow restriction means for restraining the fluid flow rate through said second passageway to a predetermined level.

* * * * *